US006331041B1

(12) United States Patent
Yoshimura et al.

(10) Patent No.: US 6,331,041 B1
(45) Date of Patent: Dec. 18, 2001

(54) INKJET PRINTING APPARATUS

(75) Inventors: Hisashi Yoshimura, Nara; Norihiro Ochi, Sakurai, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/253,008

(22) Filed: Feb. 19, 1999

(30) Foreign Application Priority Data

Feb. 20, 1998 (JP) ..... 10-038806

(51) Int. Cl.[7] ..... B41J 29/393
(52) U.S. Cl. ..... 347/19
(58) Field of Search ..... 347/19, 87, 81, 347/92, 174, 188

(56) References Cited

U.S. PATENT DOCUMENTS 5,208,605 5/1993 Drake ..... 347/40
6,062,667 * 5/2000 Matsui et al. ..... 347/19

FOREIGN PATENT DOCUMENTS 226752 1/1990 (JP) .
3290263 12/1991 (JP) .
4176660 6/1992 (JP) .
596728 4/1993 (JP) .
5201003 10/1993 (JP) .
7156391 6/1995 (JP) .

* cited by examiner

*Primary Examiner*—N. Le
*Assistant Examiner*—K. Feggins

(57) ABSTRACT

Various ink heads with holes different in diameter can be attached to a carriage of an inkjet printing apparatus. A CPU detects the type of an ink head attached, by states of signals on signal lines. The CPU executes a printing operation in a resolution corresponding to an amount of ink discharge based on a result of detection. When one of various ink heads having a plurality of holes and having the same pitch between the holes as that of one another ink head is attached, the printing operation is carried out such that the amount of ink discharge is substantially the same for the respective ink heads, in particular, that a relation of recording paper feed amount $X=(C/(P1/P-1)\times P1+P2$ is satisfied, further in particularly, $C/(P1/P2)$=a positive number. Ink heads provided with a plurality of holes arranged with the same interval may also be attached. Thus, various ink heads can be attached to the carriage to provide a plurality of resolutions and high quality prints.

8 Claims, 13 Drawing Sheets

INKJET PRINTING APPARATUS

BACKGROUND OF THE INVENTION

1. Field of the Invention

The present invention relates to an inkjet printing apparatus for printing characters, pictures and the like on a recording material by discharging ink onto the recording material.

2. Description of the Related Art

As shown in FIG. 1, a conventional inkjet printing apparatus includes a carriage 2 movable in a main scanning direction A, to which an ink head 1 can be attached. The inkjet printing apparatus further includes a platen roller 6 extending in the main scanning direction A for feeding a recording material (not shown), in a sub-scanning direction B perpendicular to the main scanning direction A. As shown in FIG. 2, the ink head 1 is attachable to the carriage 2 by opening a lock lever 4 pivotally attached to a bottom 2*a* of carriage 2, placing positioning pins 3 projecting from the bottom 2*a* of carriage 2 and positioning grooves 7 in the ink head 1 in engagement with each other, and closing the lock lever 4 to engage a projection 10*a* of lock lever 4 with a recess 10*b* formed in an upper position of ink head 1.

The carriage 2 has a group of electrical connection terminals 8 arranged on a surface of bottom 2*a* thereof. The ink head 1 also has a group of similar electrical connection terminals to those of carriage 2 arranged on a bottom surface thereof opposed to the bottom 2*a*. When the ink head 1 is attached to the carriage 2, the groups of connection terminals contact each other to become conductive. A printing operation is carried out based on information to be printed, printing control information and so on applied to the group of connection terminals 8 of carriage 2 through a cable 9 for the ink head. As shown in FIGS. 3A and FIG. 3B, the ink head 1 includes nozzle groups 11 each having a plurality of nozzles 12. The nozzles 12 are arranged vertically in a row, and are equal in diameter.

FIG. 13 is a block diagram showing an electrical construction of a conventional inkjet printing apparatus. The inkjet printing apparatus has a circuit board 41 mounted in the carriage, and a circuit board 42 mounted in the ink head. The circuit boards 41 and 42 are electrically connected to each other through the cable 9. The circuit board 41 in the carriage includes a CPU (central processing unit) 43, an interface control unit 44, an interface memory 45 and a print memory 46. The circuit board 42 in the ink head includes print head drivers 47B, 47C, 47M and 47Y.

Print information taken in by the interface control unit 44 is temporarily stored in the interface memory 45 according to input timing of the information. When print information for one line is stored, the information is transferred to the print memory 46 in a short time. Then, the ink head 1 is moved in the main scanning direction A. According to positions of the moved ink head 1, information such as on a print starting position and a particular pitch position is inputted to CPU 43, which processes and converts this information into information on a printing resolution. According to timing of the information processing and conversion, the print information stored in the print memory 46 is applied to the print head drivers 47B, 47C, 47M and 47Y. The print head drivers 47B, 47C, 47M and 47Y cause inks to be discharged from the nozzles 12.

For example, Japanese Unexamined Patent Publication JP-A 7-156391 (1995) discloses a technique for defining a relationship of arrangement of a plurality of nozzles.

Thereby, while equally dividing drive is carried out by shifting printing timing for each ink channel provided with a nozzle, printing resolution in a sub-scanning direction is compensated by providing a plurality of rows composed of a plurality of nozzles arranged on the same line.

Japanese Unexamined Patent Publications JP-A 3-290263 (1991) and JP-A 5-96728 (1993) disclose techniques for rendering an angle of nozzle arrangement variable with respect to a transport direction of a recording material. A desired resolution is obtained by appropriately setting an angle of nozzle arrangement, an amount of the recording material fed and a moving speed of the carriage in JP-A 3-290263, or by appropriately setting an angle of nozzle arrangement, a moving speed of the carriage and ink discharge timing in JP-A 5-96728.

Further, Japanese Unexamined Patent Publication JP-A 5-201003 (1993) discloses an ink head having two types of nozzle groups different in diameter. A desired resolution is obtained by appropriately selecting a nozzle group for low resolution, a nozzle group for high resolution, or a combination of the nozzle groups. Moreover, Japanese Unexamined Patent Publication JP-A 2-26752 (1990) discloses a technique of providing a plurality of ink heads for discharging different amounts of ink, and obtaining a desired resolution by selecting one of the ink heads with an ink head selecting means.

A uniform resolution is ensured with an ink head having a single type of nozzle groups of equal diameter as disclosed in JP-A 7-156391. Different resolutions may be available from an ink head with a variable arrangement angle of nozzle groups as disclosed in JP-A 3-290263 or JP-A 5-96728. However, since the nozzles are equal in diameter and ink discharge amount therefrom are also equal, a large amount of ink is discharged for high-resolution printing, resulting in smudgy prints. For low-resolution printing, a small amount of ink is discharged to form light color prints. Further, the angle of nozzle arrangement has a great influence on printing in the sub-scanning direction, and even a slight difference in the angle results in a large difference in line feed. Consequently, a blank or overlap occurs with each line feed to lower print quality. In JP-A 5-201003 and JP-A 2-26752, the ink heads have complicated constructions and are costly to manufacture, which therefore have not come into practical use yet.

Japanese Unexamined Patent Publication JP-A 4-176660 discloses an apparatus including a slider disposed adjacent an ink discharge opening for controlling an amount of ink discharge to vary the size of ink droplets, thereby to print in a plurality of tones. This apparatus has a drawback that the resolution of prints is subject to change with the size of ink droplets

SUMMARY OF THE INVENTION

An object of the present invention is to provide an inexpensive inkjet printing apparatus for forming high quality prints in a plurality of resolutions.

An inkjet printing apparatus having a carriage to which interchangeable ink heads can be attached, according to the present invention, comprises:

means for detecting a type of an ink head attached to the carriage; and a printing control circuit for executing a printing operation according to the type of the ink head based on a result of detection by the detecting means.

According to the invention, various ink heads may be attached to the carriage of the inkjet printing apparatus. The detecting means detects the type of an ink head attached to the carriage. The printing control circuit executes a printing operation according to the type of the ink head based on a result of detection. That is, a printing operation is carried out so as to control a storage position of print information and a feed amount of a recording material according to the type of the ink head. Since various ink heads can be attached, a plurality of resolutions are obtained. Since a printing operation is carried out according to the type of the ink head attached, high-quality prints are obtained. The ink head has a relatively simple construction to realize an inexpensive inkjet printing apparatus.

In the invention, the detecting means detects a diameter of an ink discharge hole provided in the ink head attached to the carriage, and the printing control circuit executes the printing operation according to the diameter of the ink discharge hole.

According to the invention, to the carriage of the inkjet printing apparatus may be attached various ink heads different in diameter of ink discharge hole.

The detecting means detects the diameter of ink discharge holes of the ink head attached to the carriage. The printing control circuit executes a printing operation according to the diameter of the ink discharge hole in the ink head, i.e. in a resolution corresponding to an ink discharge amount, on the basis of a result of the detection. Operation may be controlled such that, in time of high-speed printing, for example, ink is discharged in an increased amount to print in low resolution and, in time of high-resolution printing, ink is discharged in a decreased amount to print at low speed. In this way, an inexpensive inkjet printing apparatus is achieved to produce high-quality prints in a plurality of resolutions.

In the invention, the detecting means detects a diameter of a plurality of ink discharge holes provided in the ink heads, arranged with a same pitch, and the printing control circuit for executing the printing operation according to the diameter of the ink discharge holes executes the printing operation such that an amount of ink discharge which is a product of the number of ink dots discharged to a given area and an amount of ink discharged at a time is substantially the same for the various ink heads.

According to the invention, the various ink heads provided with the plurality of discharge holes arranged with the same pitch, can be attached to the carriage of the ink jet printing apparatus. The ink heads are different in that the discharge holes have differing diameters. The detecting means detects the diameter of the ink discharge hole. The printing control circuit executes a printing operation according to the diameter of the ink discharge hole of the ink head, i.e. in a resolution corresponding to an ink discharge amount, based on a result of the detection. In particular, the printing operation is carried out such that an amount of ink discharged is substantially the same for the various ink heads. Since the various ink heads having the plurality of ink discharge holes have the same pitches between the holes, the constructions of the ink heads are simple. Thus, the ink heads for producing high-quality prints in a plurality of resolutions may be manufactured with ease and at low cost. Where different resolutions are obtained by varying angles of arrangement of hole groups having the same diameter, an excessive amount of ink is discharged for high-resolution prints, resulting in smudgy prints, since the holes have the same diameter and the same amount of ink is discharged from the holes. For low-resolution prints, ink is discharged in a reduced amount to produce light color prints. In the present invention, however, a printing operation is carried out with substantially the same amount of ink discharge from varied ink heads. Thus, high-quality prints are obtained regardless of resolution.

In the invention, the printing control circuit executes the printing operation to satisfy a relation of $X=(C/(P1/P2)-1)\times P1+P2$ (a fractional portion of $C/(P1/P2)$, if any, being discarded), in which the resolution of prints is an integral multiple, P1 is a low-resolution print dot pitch, P2 is a high-resolution print dot pitch, C is the number of hole channels in a high-resolution ink head, and X is a feed amount of a recording material printed.

According to the invention, the printing control circuit executes the printing operation to satisfy the relation $X=(C/(P1/P2)-1)\times P1+P2$. Thus, the feed amount X of a recording material is constant at all times to feed the recording material steadily. Assume, for example, use of two interchangeable ink heads attached to the carriage, one of which is for 180 dpi, with ink discharge hole pitch P1=141.1 $\mu$m, and 32-channel ink discharge holes, and the other is for 720 dpi, with ink discharge hole pitch P2=35.25 $\mu$m, and 32-channel ink discharge holes. In printing at 180 dpi, the recording material is fed by $(P1\times 32)$ $\mu$m for each line to be printed. In printing at 720 dpi, the recording material is fed by (P2) $\mu$m after printing each line in order to fill a gap between each adjacent pair of channels. This is repeated four times to obtain what corresponds to one line printed at 180 dpi. To print a second line next, the recording material is fed by $(P1\times 32-P2\times 3)$ $\mu$m. Such feeding of the recording material for printing at 720 dpi involves difficulties to achieve steady feeding since the feed amounts are not uniform, and is likely to result in irregular feeds. Specifically, the feed amount (P2) $\mu$m for the second line is highly likely to be insufficient. In the invention, however, the feed amount X of the recording material is constant at all times, to achieve steadily feeding of the recording material with no possibility of irregular feeding.

In the invention, $C/(P1/P2)$=a positive number.

By satisfying a relation that $C/(P1/P2)$ is a positive number, according to the invention, all of the ink discharge holes are used to realize an efficient printing operation.

In the invention, the detecting means detects a diameter of a plurality of ink discharge holes provided in the ink head, the ink discharge holes being arranged at same intervals, and the printing control circuit executes the printing operation according to the diameter of the ink discharge holes.

According to the invention, various ink heads which are different from each other in diameter of the ink discharge hole provided therein can be attached to the carriage of the inkjet printing apparatus, and in particular, the ink heads are provided with the plurality of ink discharge holes arranged at the same intervals. The detecting means detects the diameter of the ink discharge holes. The printing control circuit executes a printing operation according to the diameter of ink discharge holes provided in the ink head, i.e. in a resolution corresponding to an ink discharge amount, based on a result of the detection. Since the various ink heads having the plurality of ink discharge holes are arranged at the same intervals, the arrangements correspond to different resolutions. Thus, no special operation is required to feed the recording material, thereby simplifying the operation to feed the recording material.

In the invention, the ink head has signal lines short-circuited or opened in a mode for indicating the type of the ink head, and the detecting means detects the type of the ink head based on states of signals on the signal lines when the ink head is attached to the carriage.

According to the invention, the detecting means detects the states of the signals on the signal lines of the ink head at the attachment of the ink head, to determine the type of the attached ink head based on the states of the signals. Thus, the printing operation is carried out based on a result of the detection to produce high-quality prints reliably in a plurality of resolutions.

In the invention, the ink head has a resistor with a resistance indicative of the type of the ink head, and the detecting means detects the type of the ink head based on the resistance of the resistor when the ink head is attached to the carriage.

According to the invention, the detecting means detects the resistance of the resistor at the attachment of the ink head to determine the type of the ink head attached. Thus, the printing operation is carried out based on a result of detection to produce high-quality prints reliably in a plurality of resolutions.

BRIEF DESCRIPTION OF THE DRAWINGS

Other and further objects, features, and advantages of the invention will be more explicit from the following detailed description taken with reference to the drawings wherein:

FIGS. 4A and 4B are explanatory views illustrating an ink discharging principle, in which FIG. 4A shows an inoperative state and FIG. 4B shows an operative state;

DETAILED DESCRIPTION OF THE PREFERRED EMBODIMENTS

Figure 1:
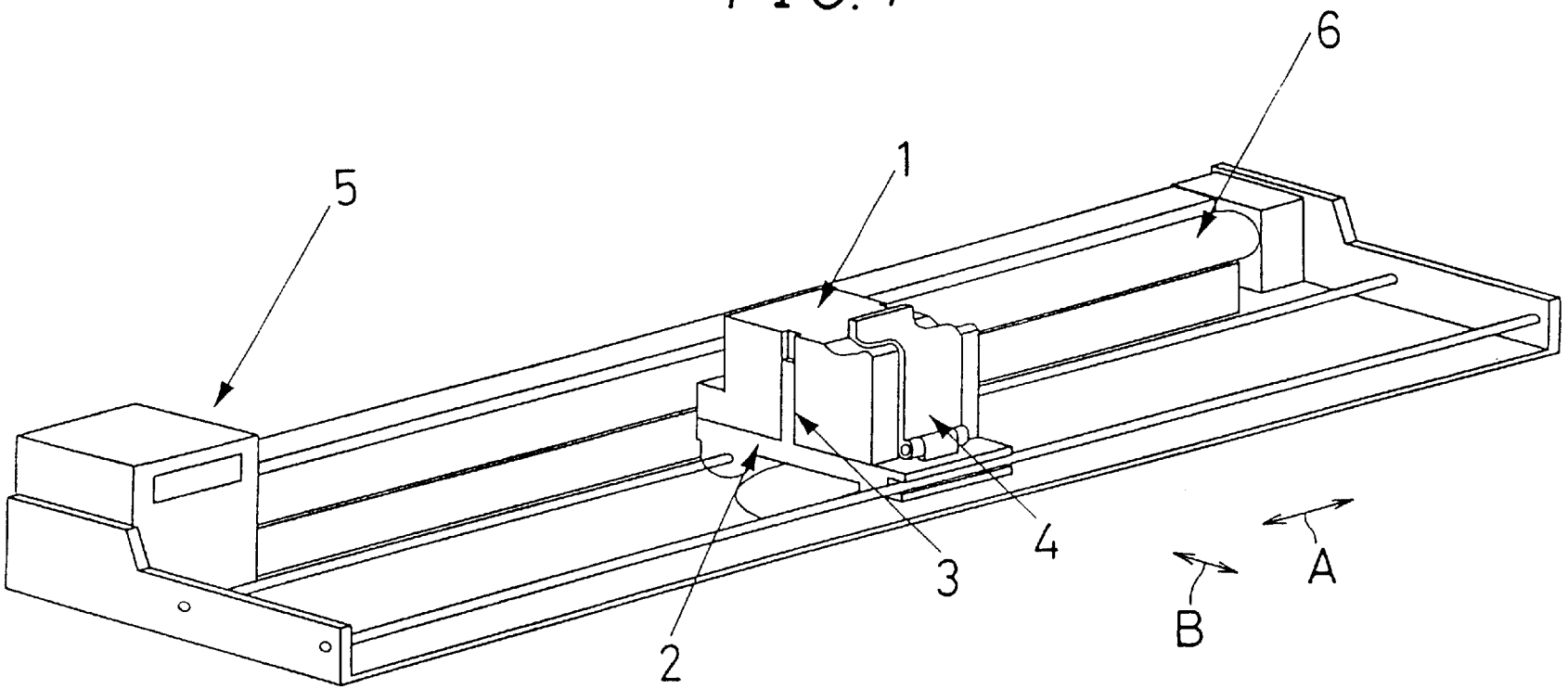
FIG. 1 is a perspective view showing an inkjet printing apparatus according to an embodiment of the present invention.

Now referring to the drawings, preferred embodiments of the invention are described below.

FIG. 1 is a perspective view showing an inkjet printing apparatus according to an embodiment of the present invention. The inkjet printing apparatus includes a carriage 2 movable in a main scanning direction A, to which one of varied ink heads 1 is attachable. The inkjet printing apparatus further includes a platen roller 6 extending in the main scanning direction A for feeding a recording material such as paper, not shown, in a sub-scanning direction B perpendicular to the main scanning direction A. The inkjet printing apparatus includes also a maintenance station 5 disposed at one end of the platen roller 6.

Figure 2:
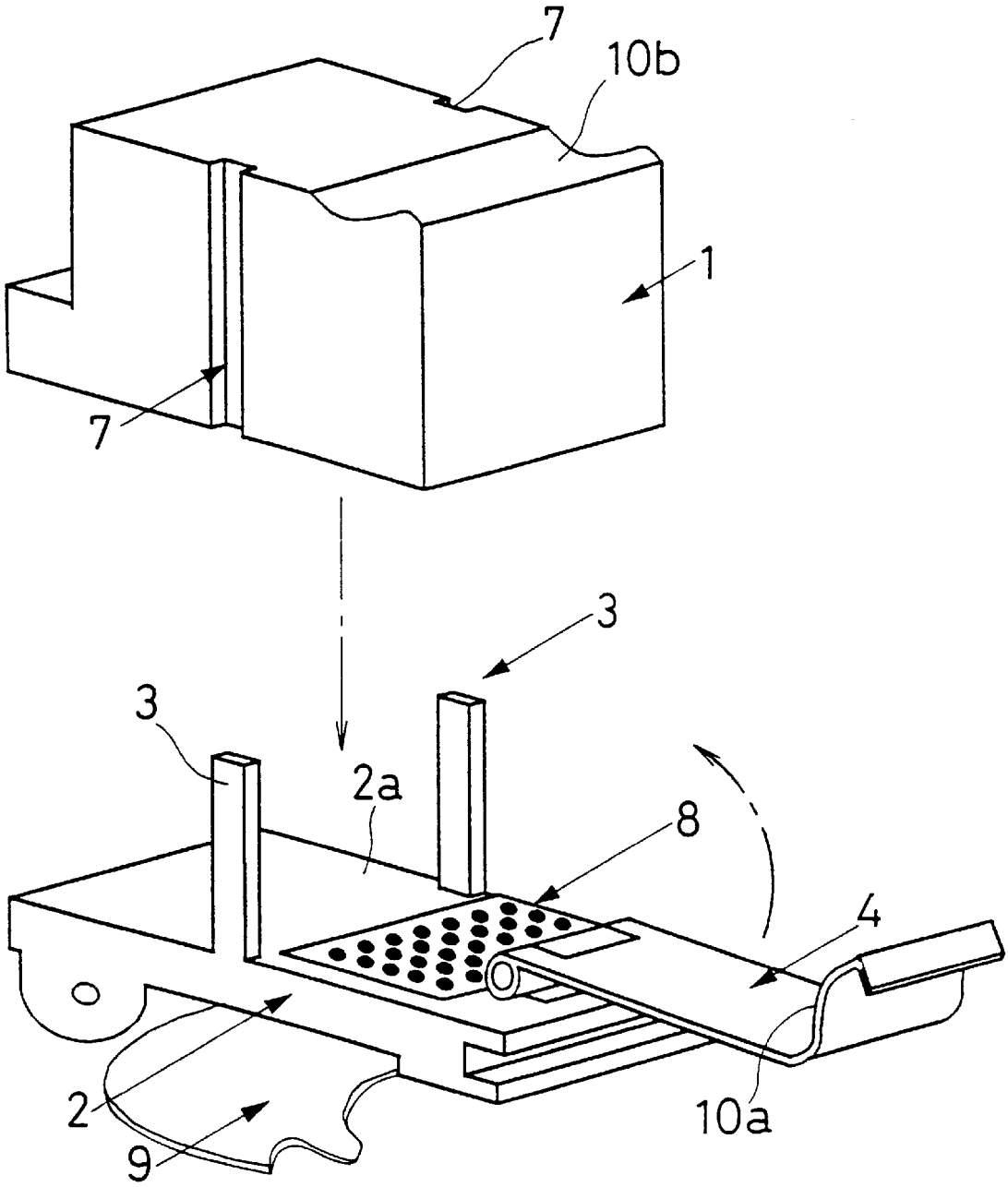
FIG. 2 exploded perspective view showing an ink head 1 and a carriage 2.

FIG. 2 is an exploded perspective view showing the ink head 1 and the carriage 2. The carriage 2 has positioning pins 3 projecting from a bottom 2*a* thereof, and a lock lever 4 pivotally attached to the bottom 2*a*. When the ink head 1 is attached, the positioning pins 3 are engaged with positioning grooves 7 of ink head 1. At this engaging, the lock lever 4 is in an open position, and is closed after the engagement of the positioning pins 3 with the positioning grooves 7, whereby a projection 10*a* of lock lever 4 is engaged with a recess 10*b* formed in an upper position of ink head. In this way, the ink head 1 is reliably attached and fixed to the carriage 2.

The carriage 2 has a group of electrical connection terminals 8 arranged on a surface of bottom 2*a* thereof. The ink head 1 also has the same group of connection terminals as those of carriage 2 arranged on a bottom surface thereof opposed to the bottom 2*a*. When the ink head 1 is attached to the carriage 2, the groups of connection terminals contact each other to become conductive. A cable 9 for the ink head is connected to the group of connection terminals 8 of carriage 2. Through the cable 9, the ink head 1 and carriage 2 receive information to be printed, printing control information and so on from a CPU described hereinafter.

Figure 3B:
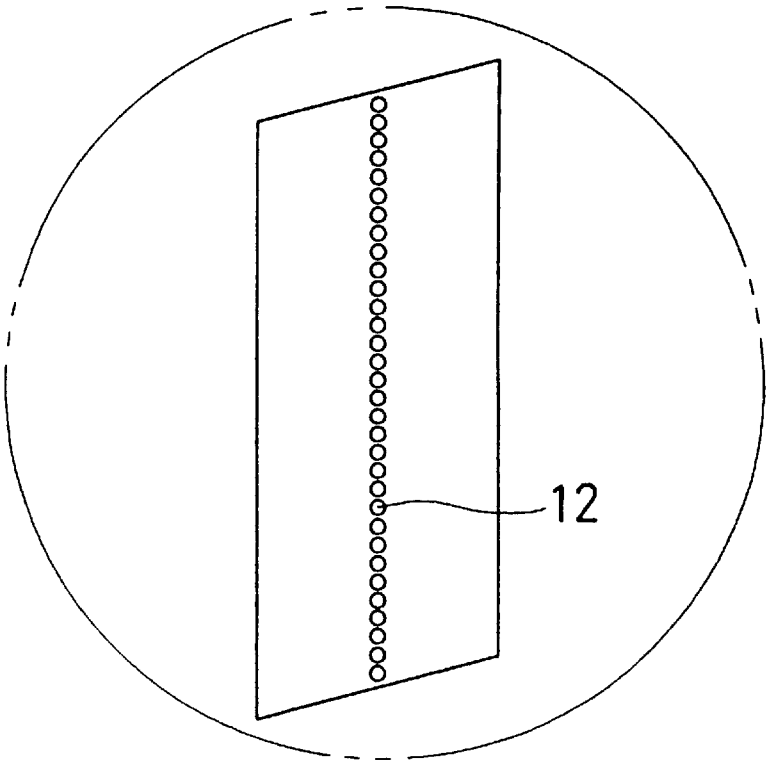
FIG. 3A and FIG. 3B are a perspective views showing nozzle groups 11 formed in the ink head 1.
Figure 3A:
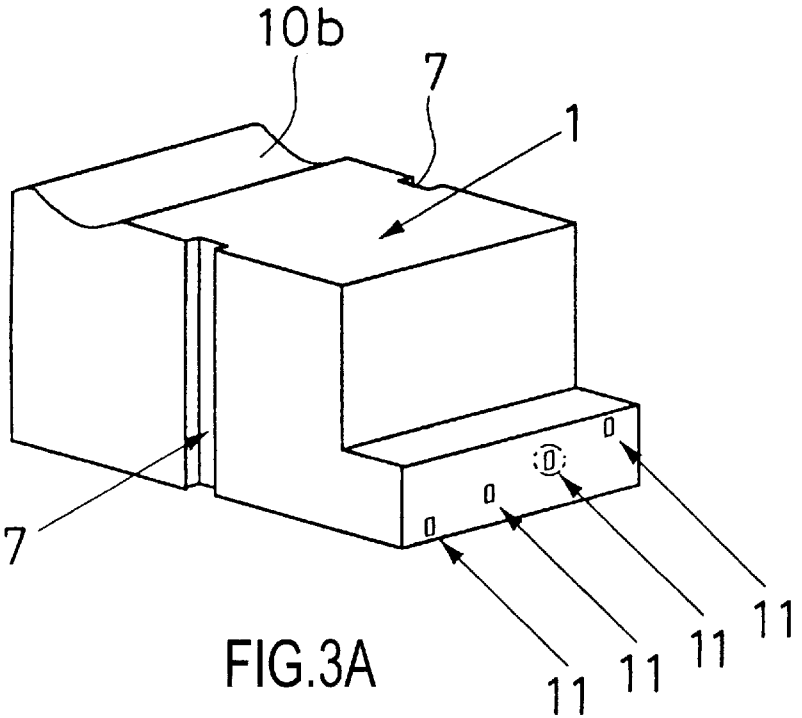

FIGS. 3A and 3B are a perspective views showing nozzle groups 11 formed in the ink head 1. The ink head 1 includes four nozzle groups 11 assigned to B (black), C (cyan), M (magenta) and Y (yellow), respectively. The nozzle groups 11 are arranged to lie opposite the platen roller 6 when the ink head 1 is attached to the carriage 2. Each nozzle group 11 includes a plurality of (32 in this example) channels of nozzles 12 acting as ink discharge nozzles. The nozzles 12 are arranged vertically in a row.

Figure 4A:
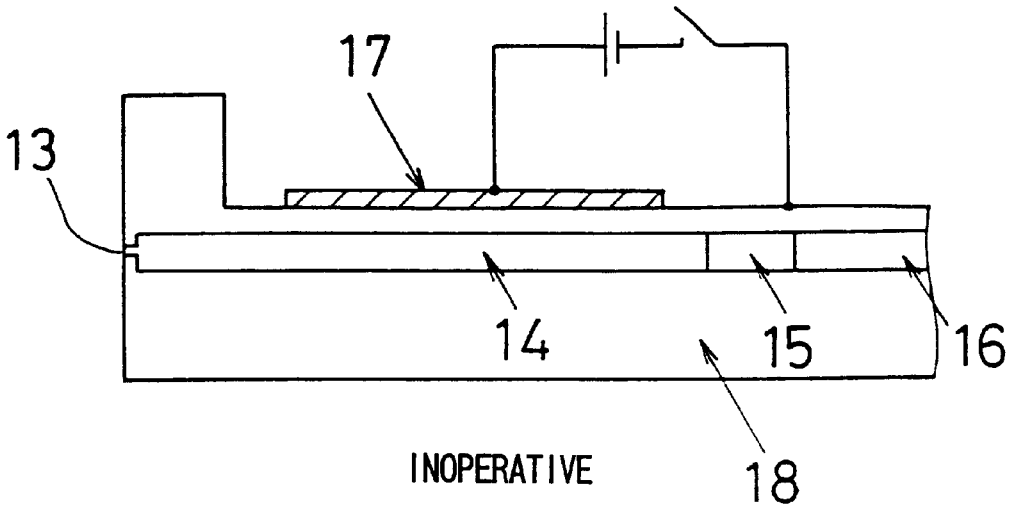
Figure 4B:
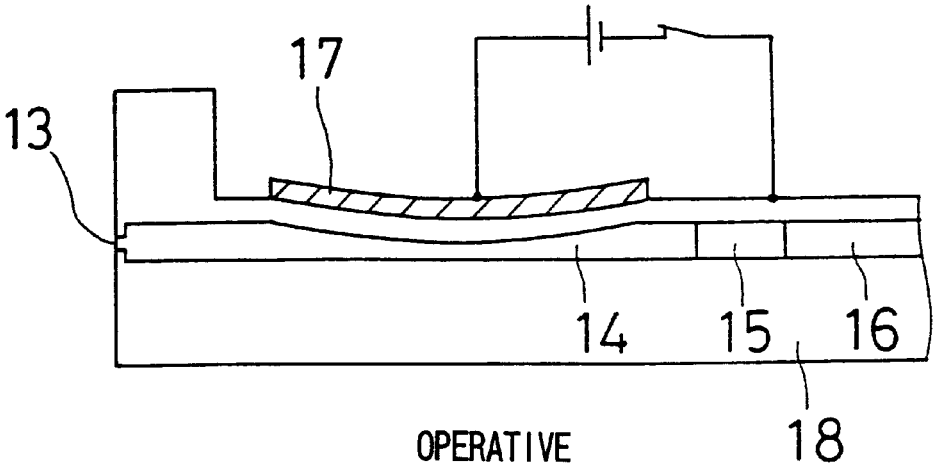

FIGS. 4A and 4B are explanatory views illustrating an ink discharging principle, in which FIG. 4A shows an inoperative state and FIG. 4B shows an operative state. The ink head 1 has a nozzle body 18 on which ink pressure chambers 14, filters 15 and a common ink supplying passage 16 arranged in the stated order are provided. An orifice 13 is formed at a forward end of each ink pressure chamber 14 for discharging ink. Piezoelectric vibrators 17 are arranged on the nozzle body 18. In the inoperative state shown in FIG. 4A, in which no voltage is applied to the piezoelectric vibrator 17, the ink pressure chamber 14 is filled with ink supplied under a capillary force from the common ink supplying passage 16 through the filter 15. When a voltage is applied to the piezoelectric vibrator 17, as shown in FIG. 4B, the vibrator 17 contracts and bends toward the pressure chamber 14 by unimorph action with a wall surface of the pressure chamber 14. The volume of pressure chamber 14 decreases to generate a pressure wave. The ink pressure chamber 14 is thereby pressurized, whereby the ink filling the chamber 14 is discharged through the orifice 13. When the voltage application is stopped, the bending of the pressure chamber wall is canceled, and ink is supplied in an amount corresponding to an increased volume. The inkjet printing apparatus discharges ink based on this principle.

This ink discharging principle is not limitative. Other type, for example, a bubble jet type which heats ink by electrifying a heater to use bubbles of boiled ink may be employed.

FIGS. 5A–5D are perspective views showing different types of ink heads 1*a* and 1*b* attachable to the carriage 2, respectively. The ink head 1*a* is for low-resolution, high-speed printing at 360 dpi. The ink head 1*b* is for high-resolution, low-speed printing at 1440 dpi. The ink heads 1*a* and 1*b* are both constructed as described with reference to FIGS. 3A and 3B, but have different nozzle diameters (i.e. diameters of the ink discharge nozzles) from each other. Specifically, the ink head 1*a* has a larger nozzle diameter than that of the ink head 1*b*. The ink heads 1*a* and 1*b* having a plurality of nozzles 12*a* and 12*b* have the same intervals between the nozzles. That is, an adjacent pair of nozzles 12*a* in the ink head 1*a* have an end-to-end distance therebetween which is equal to an end-to-end distance between an adjacent pair of nozzles 12*b*in the ink head 1*b*. Consequently, the plurality of nozzles 12*a* in the ink head 1*a* and the plurality of nozzles 12*b* in the ink head 1*b* have different lengths of arrangement.

FIGS. 6A–6D are perspective views showing another different types of ink heads 1*c* and 1*d* attachable to the carriage 2, respectively. The ink head 1*c* is for low-resolution, high-speed printing at 360 dpi. The ink head 1*d* is for high-resolution, low-speed printing at 1440 dpi. The ink heads 1*c* and 1*d* are both constructed as described with reference to FIGS. 3A and 3B, but have different nozzle diameters from each other. Specifically, the ink head 1*c* has a larger nozzle diameter than the ink head 1*d*. The ink heads 1*c* and 1*d* having a plurality of nozzles 12*c* and 12*d* have the same pitches between the nozzles. That is, an adjacent pair of nozzles 12*c* in the ink head 1*c* have a center-to-center distance therebetween which is equal to a center-to-center distance between an adjacent pair of nozzles 12*d* in the ink head 1*d*. Consequently, the plurality of nozzles 12*c* in the ink head 1*c* and the plurality of nozzles 12*d* in the ink head 1*d* have the same length of arrangement.

Figure 7:
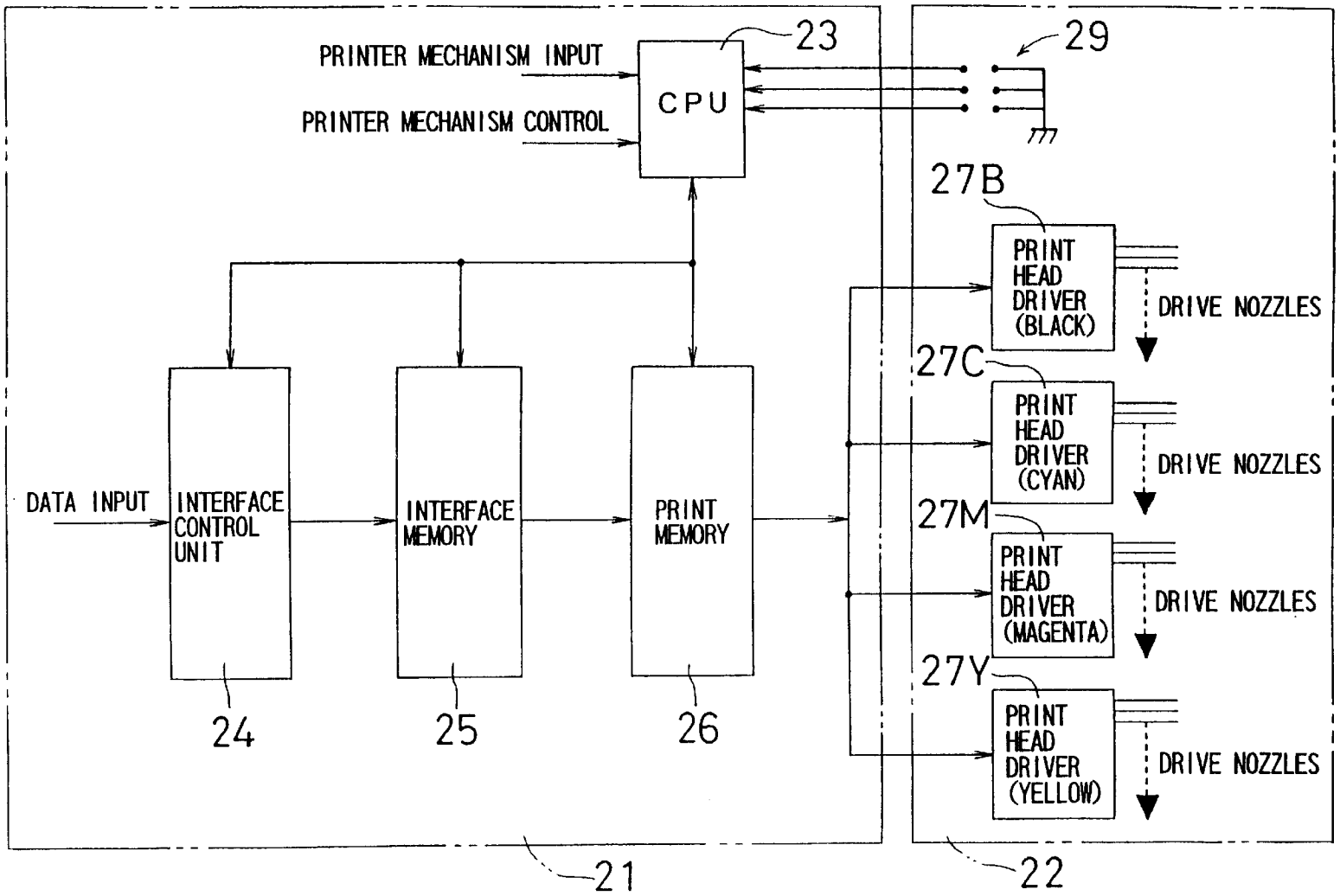
FIG. 7 is a block diagram showing an electrical construction of the inkjet printing apparatus.

FIG. 7 is a block diagram showing an electrical construction of the inkjet printing apparatus. The inkjet printing apparatus has a circuit board 21 mounted in the carriage, and a circuit board 22 mounted in the ink head. The circuit boards 21 and 22 are electrically connected to each other through the cable 9. The circuit board 21 in the carriage includes a CPU 23, an interface control unit 24, an interface memory 25 and a print memory 26. The circuit board 42 in the ink head includes print head drivers 27B, 27C, 27M and 27Y, and signal lines 29 for detecting types of ink heads.

Print information taken in by the interface control unit 24 is temporarily stored in the interface memory 25 according to input timing of the information. When print information for one line is stored in the interface memory 25, the information for one line is transferred to the print memory 26 in a short time. When print information for one line is stored in the print memory 26, the ink head 1 is moved in the main scanning direction A. According to positions of the moved ink head 1, information such as on a print starting position and a specific pitch position is inputted to CPU 23. CPU 23 processes and converts this information into information on a printing resolution. According to timing of the information processing and conversion, the print information stored in print memory 26 is applied to the print head drivers 27B, 27C, 27M and 27Y. The print head drivers 27B, 27C, 27M and 27Y cause inks to be discharged from the nozzles 12 driven based on the operating principle illustrated in FIGS. 4A and 4B.

In the inkjet printing apparatus of this embodiment, CPU 23 detects the type of ink head 1 attached to the carriage 2 based on the states of signals detected when the ink head 1 is attached. For this purpose, the signal lines 29 are connected to part of the group of connection terminals 8 shown in FIG. 2. The signal lines 29 are short-circuited to ground or opened in a predetermined way according to the type of the ink head. CPU 23 stores a relationship between the states of signals (on/off states) on the signal lines 29 detected through the group of connection terminals 8 and the types of ink heads beforehand. CPU 23 detects the states of signals when the ink head 1 is attached, determines the type of the attached ink head based on this detection results, and sets a flag corresponding to the type of ink head. While three signal lines 29 are shown here, the number of signal lines 29 is not limited to three. It may be one, two or more.

Figure 8:
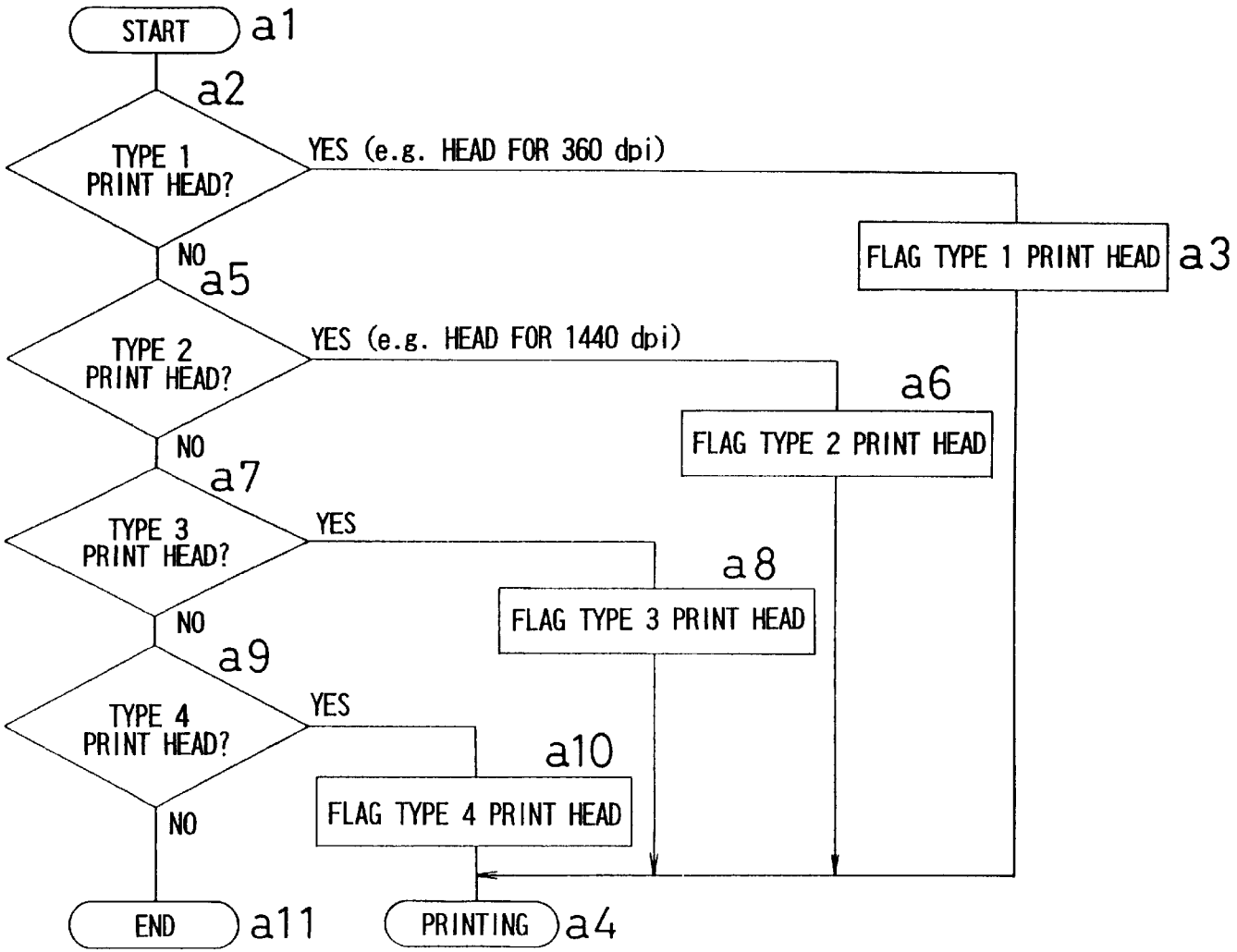
FIG. 8 is a flow chart showing an operation of CPU 23 for detecting types of ink head 1.

FIG. 8 is a flow chart showing an operation of CPU 23 for detecting types of ink head 1. The detecting operation starts at step a1, and proceeds to step a2 to determine whether the ink head 1 attached is the first type. When it is the first type, the operation proceeds to step a3. Otherwise the operation proceeds to step a5. At step a3, among the flags corresponding to the types of ink heads, the one corresponding to the first type is set, and the operation proceeds to step a4 to carry out a printing operation with the ink head of the first type.

At step a5, the determination whether the ink head 1 attached is the second type is executed. When it is the second type, the operation proceeds to step a6. Otherwise, the operation proceeds to step a7. At step a6, among the flags corresponding to the types of ink heads, the one corresponding to the second type is set, and the operation proceeds to step a4 to carry out a printing operation with the ink head of the second type.

At step a7, the determination whether the ink head 1 attached is the third type is executed. When it is the third type, the operation proceeds to step a8. Otherwise, the operation proceeds to step a9. At step a8, among the flags corresponding to the types of ink heads, the one corresponding to the third type is set, and the operation proceeds to step a4 to carry out a printing operation with the ink head of the third type.

At step a9, the determination whether the ink head 1 attached is the fourth type is executed. When it is the fourth type, the operation proceeds to step a10. Otherwise, the operation proceeds to step a11. At step a10, among the flags corresponding to the types of ink heads, the one corresponding to the fourth type is set, and the operation proceeds to step a4 to carry out a printing operation with the ink head of the fourth type. At step a11, it is determined that no ink head is attached, and the detecting operation is terminated.

In the example shown in FIG. 8, the detecting operation for four types of ink heads is illustrated. A similar detecting operation may be carried out for a single type or plural types other than four types of ink heads. Where a detecting operation is carried out with three signal lines 29 as shown in FIG. 7, for example, eight types can be detected.

Figure 9:
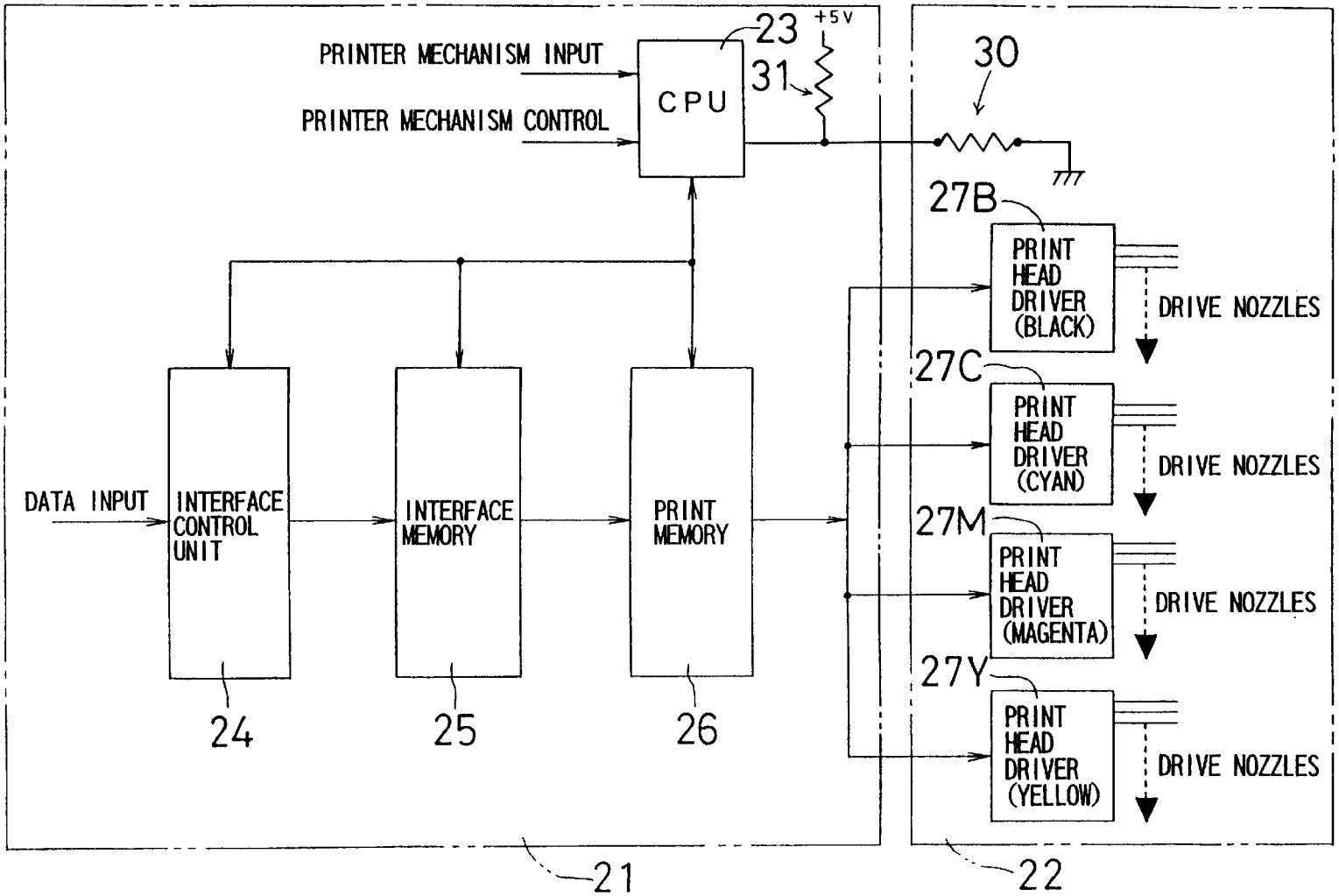
FIG. 9 is a block diagram showing another electrical construction of the inkjet printing apparatus.

FIG. 9 is a block diagram showing another electrical construction of the inkjet printing apparatus. In place of the signal lines 29 for detecting the types of the ink heads, the circuit board 22 includes a detecting resistor 30 with one end thereof short-circuited to ground, while the circuit board 21 includes a resistor 31 pulled up, for example, to +5V. The other aspects of the construction are the same as in FIG. 7. The resistor 30 has values of resistance set beforehand according to the types of ink head 1. CPU 23 stores a relationship between voltages divided by the different resistance values of resistors 30 and 31 and the types of ink heads beforehand. CPU 23 detects the voltages divided when the ink head 1 is attached, determines the type of the attached ink head based on this detection results, and sets a flag corresponding to the type of ink head.

This CPU 23 of the inkjet printing apparatus further carries out a printing operation based on the state of flags, i.e. a printing operation according to the type of ink head. Firstly, CPU 23 controls memory positions when print information is transferred from the interface memory 25 to the print memory 26. That is the interface memory 25 stores the print information intact as it is taken in. The print memory 26 stores the print information in the way in which the information is to be printed. Thus, CPU 23 changes memory positions when transferring the print information from the interface memory 25 to the print memory 26. Specifically, CPU 23 controls memory positions in the interface memory 25 for storing the number of dots to be printed on one line (printing width in the main scanning direction [inches]×print resolution [dpi]) for each resolution.

Secondly, CPU 23 controls addresses for writing and reading information, and determines whether all information has been stored in all memory positions. The amount of information is variable with resolution. Specifically, the memory positions in the print memory 26 are controlled to store the number of dots to be printed on one line for each resolution. Thirdly, CPU 23 controls printing positions for printing dots in positions corresponding to each resolution, and controls feeding of recording paper according to the resolution.

Figure 6C:
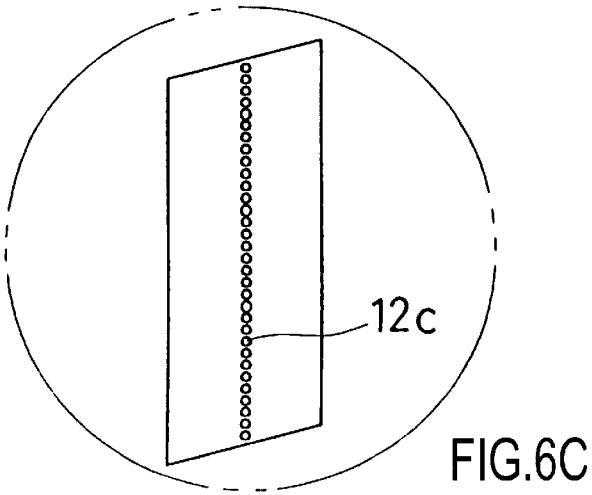
FIGS. 6A–6D are perspective views showing other different types of ink heads 1*c* and 1*d* attachable to the carriage 2, respectively.
Figure 6D:
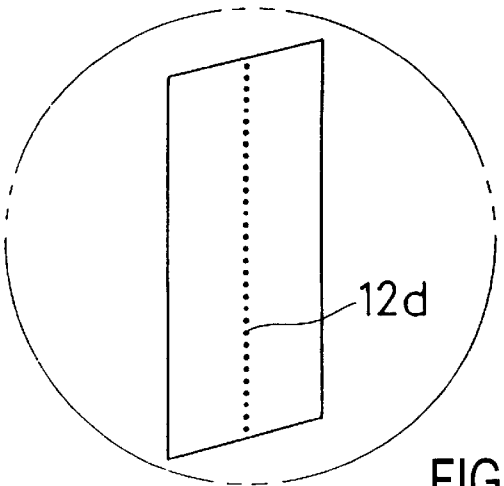
Figure 6A:
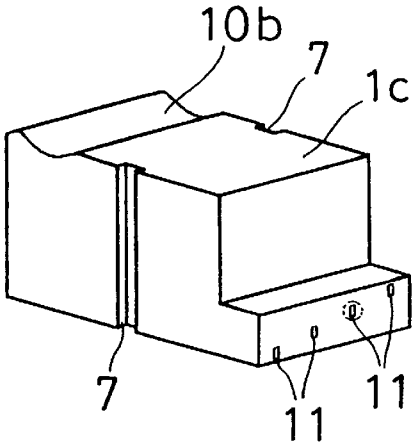
Figure 6B:
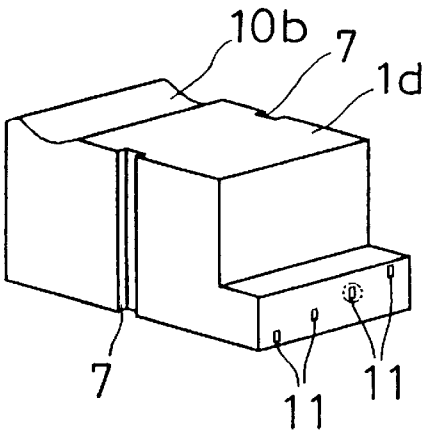

Next, specific printing operations carried out with the ink head 1*c* for low-resolution, high-speed printing at 360 dpi shown in FIGS. 6A and 6C, and the ink head 1*d* for high-resolution, low-speed printing at 1440 dpi shown in FIGS. 6B and 6D, which are interchanged for use, will be described with reference to examples of print patterns shown in FIG. 10. With the ink head 1*c* for low-resolution, high-speed printing at 360 dpi, recording paper is fed by the number of ink discharge channels×1/360 [inches] after printing the first line. Such printing and paper feeding are repeated. With the ink head 1*d* for high-resolution, low-speed printing at 1440 dpi, to perform printing corresponding to one line printed with the ink head 1*c* of 360 dpi, ink dots are discharged in four times dot density in the main scanning direction A, and recording paper is fed in a density of 4×1/1440 [inches] in the sub-scanning direction B. Next, to print the second line, the recording paper is fed by the number of ink discharge channels×1/360 [inches]−3/1440 [inches]. Such printing and paper feeding are repeated.

Tables 1 below shows amounts of ink for 1 $cm^2$ and print conditions on various types of recording paper A–E when printed with the ink head 1*c* of 360 dpi. Tables 2 shows amounts of ink for 1 $cm^2$and print conditions on recording paper A–E when printed with the ink head 1*d* of 1440 dpi.

TABLE 1

| ink amount | recording paper | | | | |
|---|---|---|---|---|---|
| for 1 $cm^2$ | A | B | C | D | E |
| 0.5 mg | too small dots | too small dots | too small dots | too small dots | good |
| 1.0 mg | good | too small dots | good | too small dots | good |
| 1.5 mg | good | good | good | too small dots | good |
| 2.0 mg | good | good | good | good | good |
| 2.5 mg | good | good | good | good | smudgy prints |
| 3.0 mg | smudgy prints | good | good | good | smudgy prints |
| 3.5 mg | smudgy prints | good | smudgy prints | good | smudgy prints |

TABLE 1-continued

| ink amount | recording paper | | | | |
|---|---|---|---|---|---|
| for 1 $cm^2$ | A | B | C | D | E |
| 4.0 mg | smudgy prints | smudgy prints | smudgy prints | smudgy prints | smudgy prints |

TABLE 2

| ink amount | recording paper | | | | |
|---|---|---|---|---|---|
| for 1 $cm^2$ | A | B | C | D | E |
| 0.5 mg | too small dots | too small dots | too small dots | too small dots | good |
| 1.0 mg | good | too small dots | good | too small dots | good |
| 1.5 mg | good | good | good | good | good |
| 2.0 mg | good | good | good | good | good |
| 2.5 mg | good | good | good | good | smudgy prints |
| 3.0 mg | smudgy prints | good | good | good | smudgy prints |
| 3.5 mg | smudgy prints | good | smudgy prints | good | smudgy prints |
| 4.0 mg | smudgy prints | smudgy prints | smudgy prints | smudgy prints | smudgy prints |

The results in Tables 1 and 2 indicate that, preferably, recording paper C should be used as a standard, and ink heads used should discharge ink in 1.5 mg per 1 $cm^2$. Specifically, preferred nozzle diameters are 45m for 360 dpi ink heads, and 25 $\mu$m for 1440 dpi ink heads.

Figure 10:
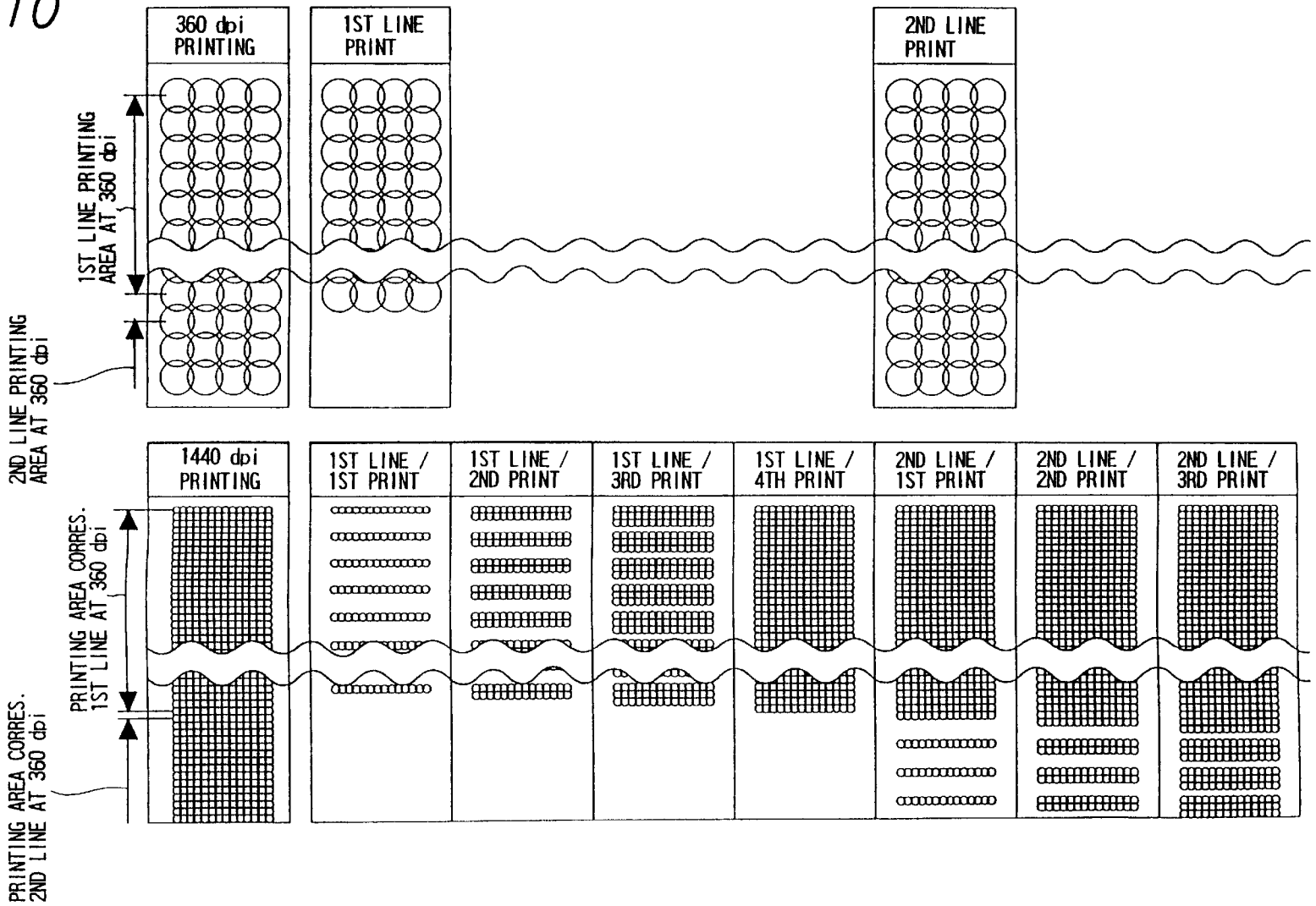
FIG. 10 an explanatory view showing examples of print patterns for illustrating a printing operation using the ink heads 1*c* and 1*d;*

In the printing operations illustrated in FIG. 10, after printing one line with the total number of ink discharge nozzles, a next line is printed. Such printing operations enable high-speed printing but provide low-quality prints. That is, banding patterns appear, which are stripes produced by ink bleeding in each line. A feed amount X of recording paper printed is obtained from the following relation:

$$X=(C/(P1/P2-1)\times P1+P2,$$

wherein the resolution of prints is an integral multiple, P1 is a low-resolution print dot pitch, P2 is a high-resolution print dot pitch, and C is the number of nozzle channels in a high-resolution ink head. To realize high-quality prints, the feed amount X should preferably be established as follows: when P1=1/360 (approximately 70 $\mu$m), P2=1/1440 (approximately 17.5 $\mu$m), and C=32, $$X=(32/(70/17.5)-1)\times 70+17.5=507.5\ [\mu m]$$

Figure 11:
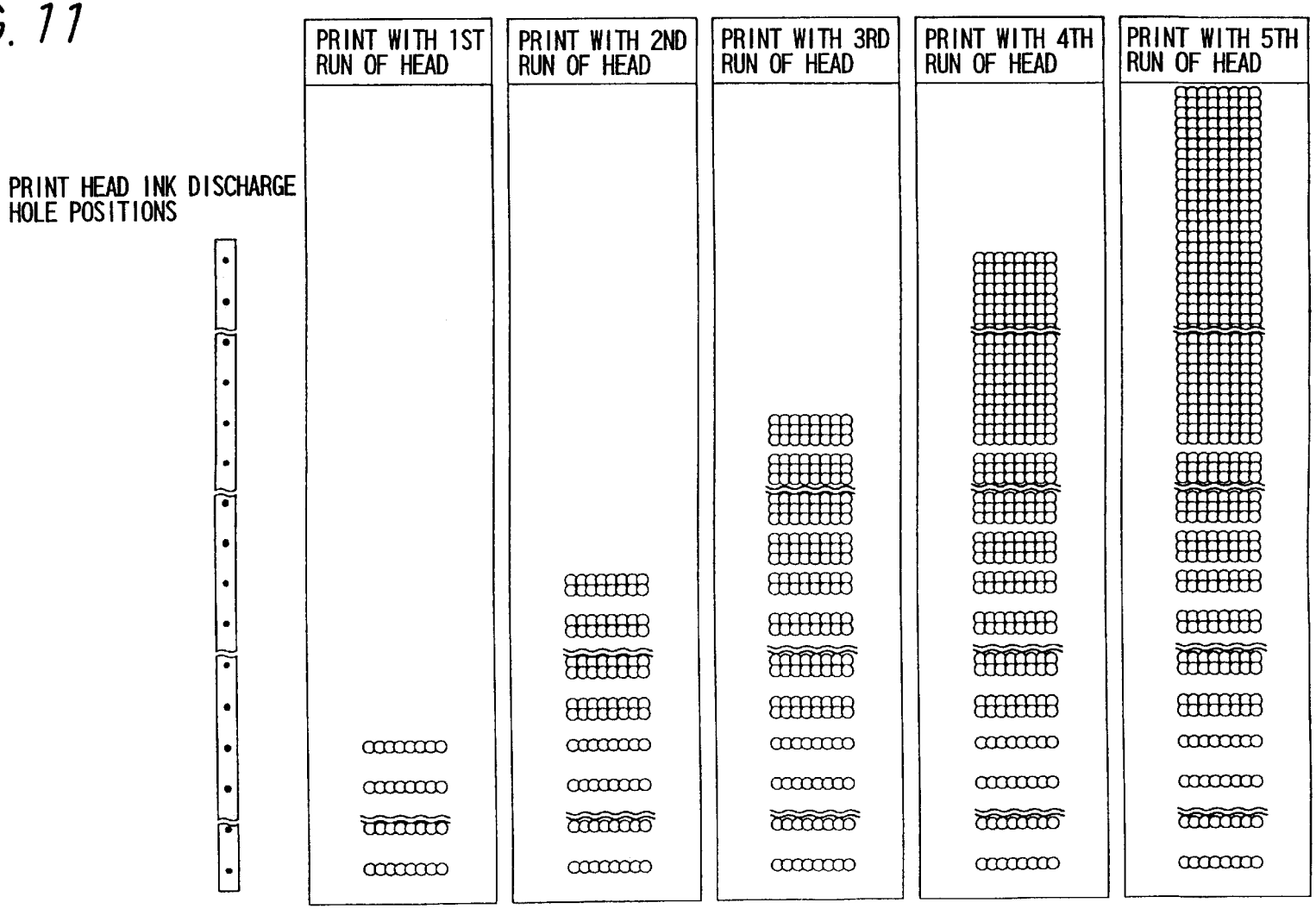
FIG. 11 is an explanatory view showing another examples of print patterns for illustrating a printing operation using the ink heads 1*c* and 1*d;*

However, a fractional portion of C/(P1/P2 ), if any, is discarded. Then, printing operations are carried out as shown in FIG. 11, to suppress a decrease in printing speed and reduce banding patterns.

The ink heads 1*c* and 1*d* shown in FIGS. 6A–6D, which are interchangeable for attachment, are different only in nozzle diameter, the ink heads 1*c* and 1*d* having the same pitches between the nozzles. Thus, these ink heads may be manufactured simply and at low cost.

Figure 5C:
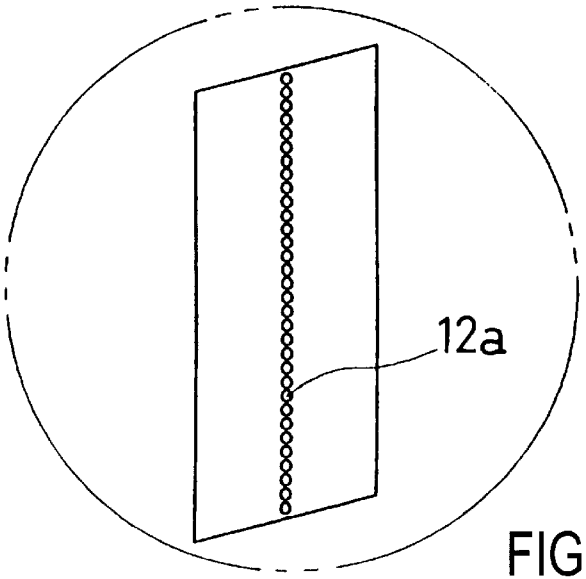
FIGS. 5A–5D are perspective views showing different types of ink heads 1*a* and 1*b* attachable to the carriage 2, respectively.
Figure 5D:
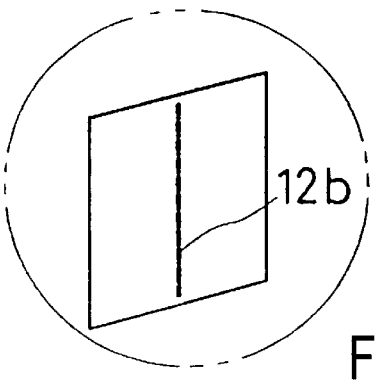
Figure 5A:
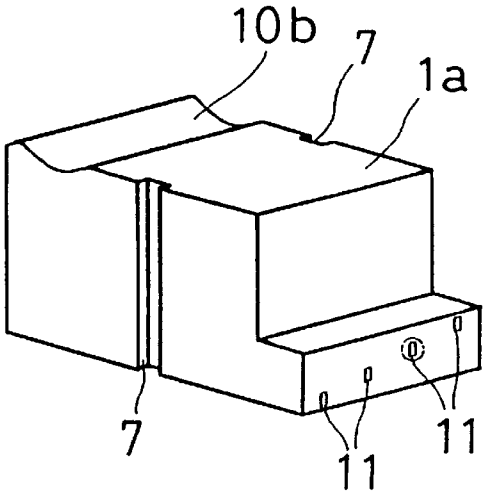
Figure 5B:
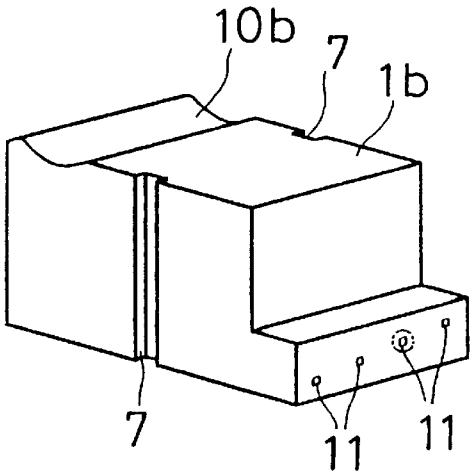
Figure 12:
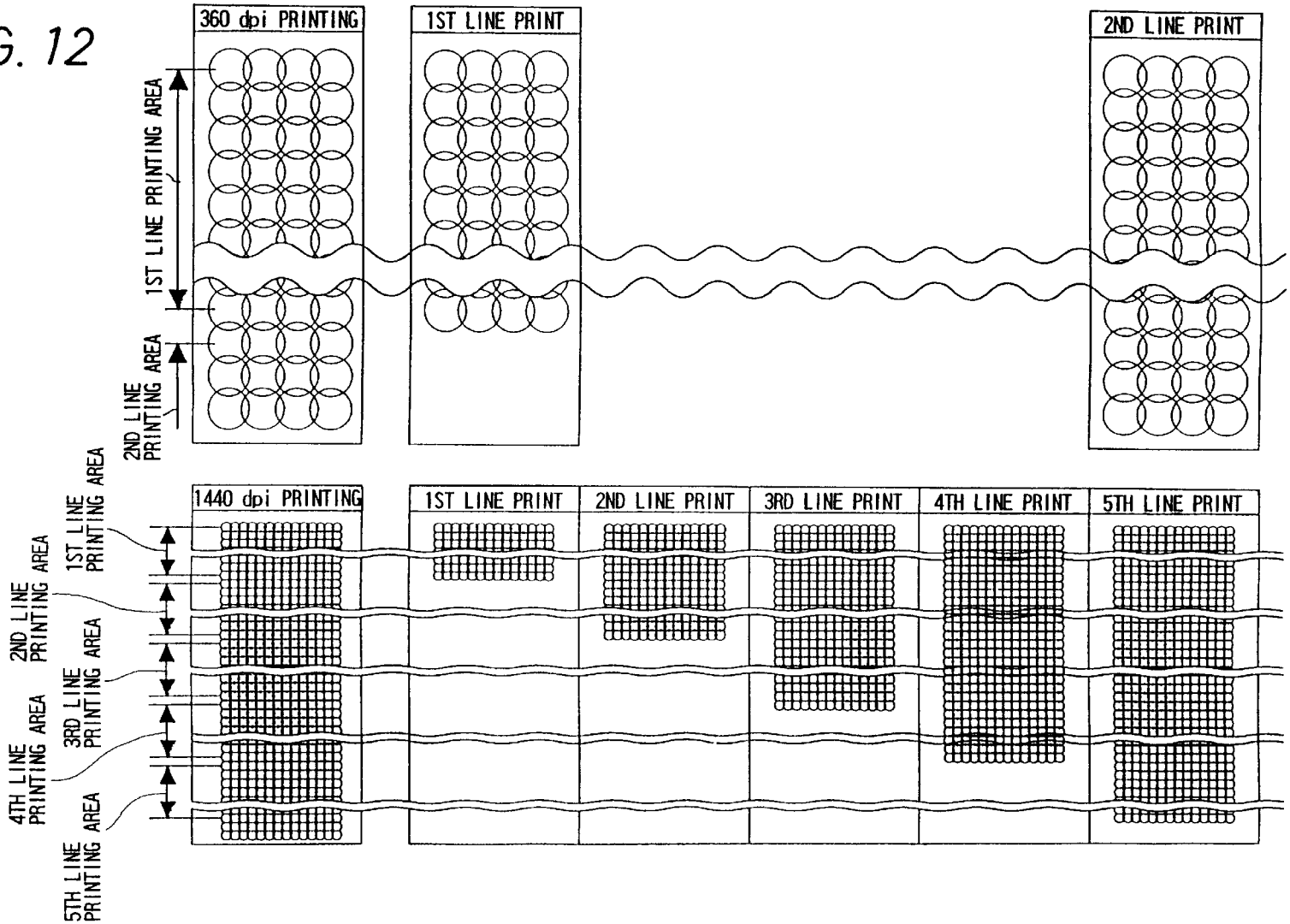
FIG. 12 is an explanatory view showing examples of print patterns for illustrating a printing operation using the ink heads 1*a* and 1*b.
Figure 13:
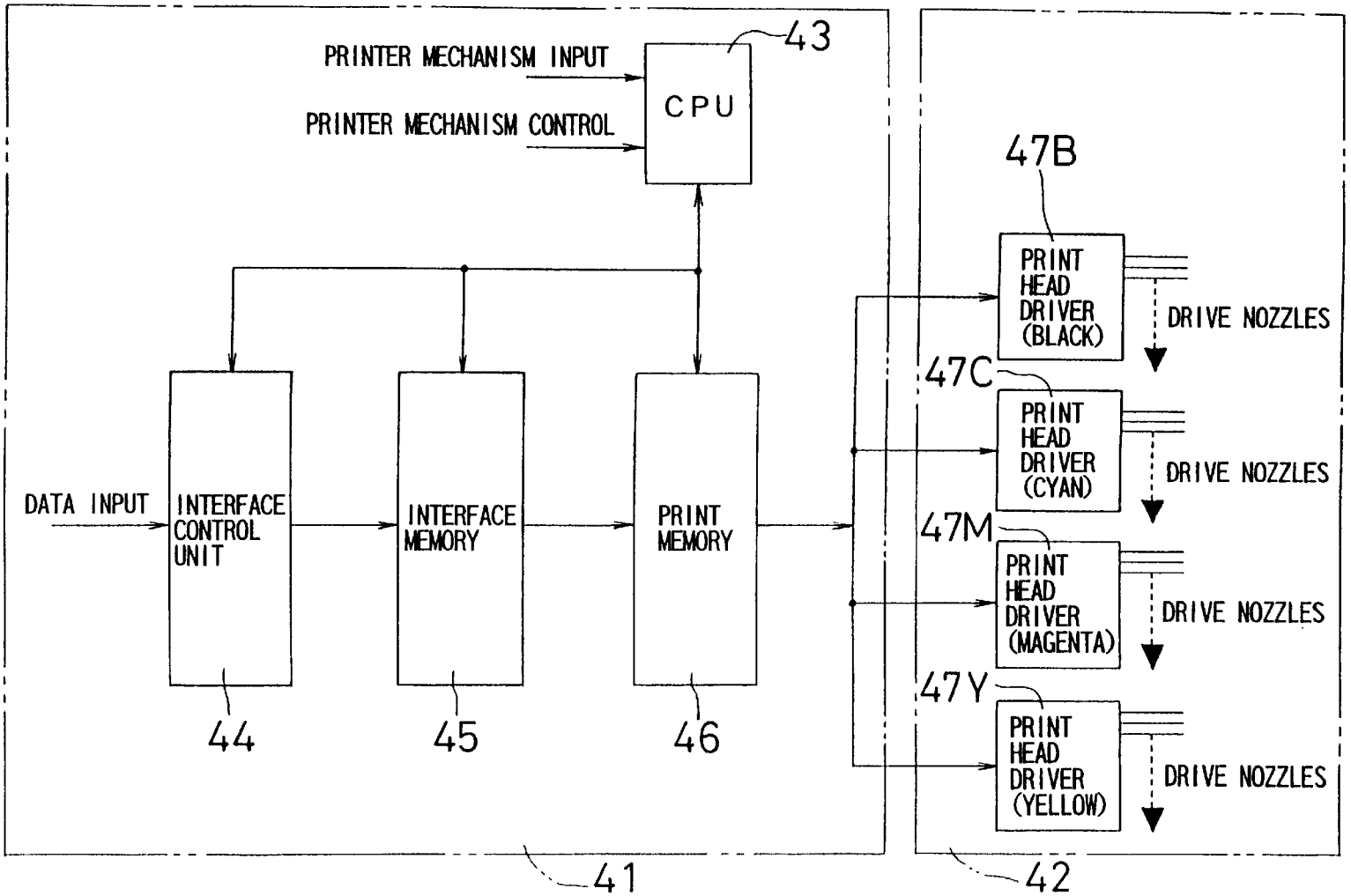
FIG. 13 PRIOR ART
* and FIG. 13 is a block diagram showing an electrical construction of a conventional inkjet printing apparatus.

FIG. 12 illustrates printing operations with the ink head 1*a* for low-resolution, high-speed printing at 360 dpi shown in FIGS. 5A and 5C and the ink head 1*b* for high-resolution, low-speed printing at 1440 dpi shown in FIGS. 5B and 5D, which are interchanged for use. With the ink head 1*a* for low-resolution, high-speed printing at 360 dpi, recording paper is fed by the number of ink discharge channels×1/360 [inches] after printing the first line. Such printing and paper feeding are repeated. With the ink head 1*b* for high-resolution, low-speed printing at 1440 dpi, recording paper is fed by the number of ink discharge channels×1/1440 [inches]. Such printing and paper feeding are repeated. It is sufficient to repeat such a simple operation to print and feed the paper.

However, the ink heads 1*a* and 1*b* shown in FIGS. 5A–5D, which are interchangeable for attachment, are different not only in nozzle diameter but in nozzle pitch. These ink heads are complicated and expensive to manufacture.

According to this embodiment, as described above, various ink heads 1, particularly ink heads 1 different in ink discharge nozzle diameter, may be attached to the carriage 2 of the inkjet printing apparatus. Consequently, various resolutions may be provided. The ink heads 1 interchangeable for attachment have relatively simple constructions to realize an inexpensive inkjet printing apparatus.

Also, the inkjet printing apparatus detects the type of ink head 1 attached, particularly the diameter of ink discharge nozzles, and, based on the detection results, carries out a printing operation according to the type of ink head 1, i.e. a printing operation in a resolution corresponding to an amount of ink discharge. Thus, an inexpensive inkjet printing apparatus is achieved which produces high-quality prints in a plurality of resolutions.

When attaching for use varied ink heads 1*c* and 1*d* having different ink discharge nozzle diameters as shown in FIGS. 6A–6D, particularly ink heads 1*c* and 1*d* having a plurality of ink discharge nozzles and having the same pitches between the nozzles, a printing operation in a resolution corresponding to an amount of ink discharge is carried out such that the amount of ink discharge is substantially the same for the two ink heads 1*c* and 1*d*. As a result, high-quality prints are obtained regardless of resolution. In particular, such a printing operation is carried out to satisfy $X=(C/(P1/P2)-1)\times P1+P2$ (a fractional portion of $C/(P1/P2)$, if any, is discarded). Thus, feed amount X of recording paper is constant at all times to achieve a steady transport of the recording paper. By satisfying $C/(P1/P2)$=a positive number, all of the ink discharge nozzles are used to achieve an efficient printing operation.

When attaching for use varied ink heads 1*a* and 1*b* having different ink discharge nozzles diameters as shown in FIGS. 5A–5D, the ink heads 1*a* and 1*b* having a plurality of ink discharge nozzles and having the same intervals between the nozzles, the arrangement of ink discharge nozzles corresponds to a resolution. It is therefore unnecessary to feed recording paper in a special way, which facilitates control of the print operation.

When attaching ink head 1, the states of signals on the signal lines 29 of ink head 1 are detected to determine the type of ink head 1 attached from the detected signal states. Alternatively, the voltages divided by the resistors 30 and 31 are detected to determine the type of ink head attached from the detected voltages. By conducting a printing operation based on these detection results, high-quality prints are obtained in a plurality of resolutions reliably.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An inkjet printing apparatus provided with a carriage to which interchangeable ink heads can be attached, comprising:

means for detecting a type of an ink head attached to the carriage; and a printing control circuit for executing a printing operation according to the type of the ink head attached to the carriage on the basis of a result of detection by the detecting means.

2. The inkjet printing apparatus of claim 1, wherein the detecting means detects a diameter of an ink discharge hole provided in the ink head, and the printing control circuit executes a printing operation according to the diameter of the ink discharge hole.

3. The inkjet printing apparatus of claim 2, wherein the detecting means detects a diameter of a plurality of ink discharge holes provided in the ink heads, the plurality of ink discharge holes being arranged with a same pitch, and the printing control circuit for executing the printing operation according to the diameter of the ink discharge holes executes the printing operation such that an amount of ink discharge which is a product of the number of ink dots discharged to a given area and an amount of ink discharged at a time is substantially the same for each ink head.

4. The inkjet printing apparatus of claim 3, wherein the printing control circuit executes the printing operation to satisfy a relation of $X=(C/(P1/P2)-1)\times P1+P2$ (a fractional portion of $C/(P1/P2)$, if any, being discarded), in which a resolution of prints is an integral multiple, P1 is a low-resolution print dot pitch, P2 is a high-resolution print dot pitch, C is a number of hole channels in a high-resolution ink head, and X is a feed amount of a recording material printed.

5. The inkjet printing apparatus of claim 4, wherein $C/(P1/P2)$ is a positive number.

6. The inkjet printing apparatus of claim 2, wherein the detecting means detects a diameter of a plurality of ink discharge holes provided in the ink head, the ink discharge holes being arranged at same intervals between the holes, and the printing control circuit executes the printing operation according to the diameter of the ink discharge holes.

7. The inkjet printing apparatus of claim 1, wherein the ink head has signal lines short-circuited or opened in a mode for indicating the type of the ink head, and the detecting means detects the type of the ink head based on states of signals on the signal lines when the ink head is attached to the carriage.

8. The inkjet printing apparatus of claim 1, wherein the ink head has a resistor with a resistance indicative of the type of the ink head, and the detecting means detects the type of the ink head based on the resistance of the resistor when the ink head is attached to the carriage.

* * * * *